United States Patent [19]

Coleman

[11] Patent Number: 4,812,603

[45] Date of Patent: Mar. 14, 1989

[54] DIMMER SWITCH

[75] Inventor: Donald J. Coleman, University Heights, Ohio

[73] Assignee: Eaton Corporation, Cleveland, Ohio

[21] Appl. No.: 158,059

[22] Filed: Feb. 12, 1988

Related U.S. Application Data

[63] Continuation of Ser. No. 919,997, Oct. 17, 1986, abandoned.

[51] Int. Cl.[4] ..... H01H 13/66

[52] U.S. Cl. ..... 200/570; 200/6 B; 200/416

[58] Field of Search ..... 200/156, 284, 64, 6 B, 200/17 B

[56] References Cited

U.S. PATENT DOCUMENTS

| | | | |
|---|---|---|---|
| 3,204,067 | 8/1965 | Brown | 200/156 |
| 3,604,975 | 9/1971 | Suzuki et al. | 315/83 |
| 3,648,101 | 7/1972 | Suzuki | 315/82 |
| 3,671,802 | 6/1972 | Ballou | 315/83 |
| 3,883,710 | 5/1975 | Hanssen et al. | 200/156 |
| 4,339,667 | 7/1982 | Bergmann et al. | 307/10 |
| 4,398,069 | 8/1983 | Olsson | 200/339 |
| 4,464,549 | 8/1984 | Fujita | 200/156 |
| 4,599,501 | 7/1986 | Migrin | 200/156 |

*Primary Examiner*—Renee S. Luebke

*Attorney, Agent, or Firm*—R. A. Johnston

[57] ABSTRACT

A switch including a plunger adapted for reciprocal motion in a housing. A substantially rigid first wiper is fixedly mounted to a cam for selective rotation in the housing. One end of the plunger engages the cam for altering the position of the first wiper relative to an electrical contact. The first wiper and electrical contact are arranged to define a make-before-break switching action. A cam follower provides a detent action of the cam which facilitates high speed switching independent of the actuation speed of the plunger. A second wiper is interposed between opposed ends of the plunger and selectively actuates a flash-to-pass feature.

6 Claims, 5 Drawing Sheets

DIMMER SWITCH

This application is a continuation of application Ser. No. 919,997, filed 10/17/86, now abandoned.

BACKGROUND OF THE INVENTION

This invention pertains to the art of switches, and more particularly to make-before-break switches.

The invention is particularly applicable to a dimmer switch used to control headlights on an automotive vehicle in conjunction with a flash-to-pass or so-called silent horn, and will be described with particular reference thereto. However, it will be appreciated that the invention has broader applications and may be advantageously employed in other switching environments and applications.

Reference is made to U.S. Pat. No. 3,883,710 of Hanssen, et al. issued May 13, 1975 which is herein incorporated by reference and is directed to a predecessor dimmer switch. Although this switch mechanism has met with commercial success, selected portions of the switch, as will be noted below, are believed capable of further improvement. From a purely economic standpoint, the terminals as described in the Hanssen patent result in a high cost of manufacture due to tolerance, fit, and positioning problems as well as detailed handling during assembly. Although the switch is rather compact in nature, it necessarily includes a series of bends in the terminals which result in the tolerance and position problems. Each terminal has to be individually and selectively plated.

The wiper blades in the prior art switch of the Hanssen, et al. patent include three resilient arms designed to each contain their own spring load and bear against various portions of an electrical contact. Since each arm is resiliently biased with respect to the remainder of the wiper assembly, each wiper finger imposes its own spring load on the contact portions which leads to uneven contact forces and erosion failure. Further, each arm is difficult to manufacture to the required tolerance.

Assembly of the prior art switch requires insertion of a pre-installation pin for correct placement on the steering column. Without this pin, alignment of the switch is difficult to determine and results in improper forces and positioning of the dimmer switch.

The prior art actuator cap is disposed along the exterior of the switch body. Although having predetermined stop limit positions, the cap necessarily enlarges the overall size of the switch. The actuator cap is also subject to some limited wobble with respect to the body.

Lastly, the "feel" of the prior switch is described as mushy and lacking in a positive, crisp actuation. Further studies appear to indicate that the force/displacement curve of the switch does not illustrate the theoretical sharp decrease in the force past a detent position. Further, the stroke of the switch is considered too large.

The subject invention is deemed to provide an improved dimmer switch with flash-to-pass capabilities that overcomes all of the above-noted deficiencies in an economical manner.

SUMMARY OF THE INVENTION

According to the present invention, there is provided an improved dimmer switch that includes a new wiper design and installation of an additional wiper providing flash-to-pass features.

According to the invention, the switch includes a plunger adapted for reciprocal motion in a housing and a substantially rigid first wiper having wiper arms adapted for selective engagement with an electrical contact.

According to another aspect of the invention, the electrical contact is disposed in generally planar arrangement with associated terminals.

According to a further aspect of the invention, a second wiper is adapted for selective engagement with the electrical contact.

According to yet another aspect of the invention, first means for biasing the first wiper toward the electrical contact is provided.

According to a still further aspect of the invention, second means for biasing the second wiper toward the electrical contact is provided.

A principal advantage of the invention is realized in the new wiper design that limits erosion failure of the wiper fingers.

Another advantage resides in the decreased costs of manufacturing and assembly of the switch.

Yet another advantage is found in the adaptability of the new design to hard-wiring.

Still another advantage resides in the crisp feel, decreased stroke, and sharp drop-off in input actuating force once the plunger advances.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part thereof and wherein.

DETAILED DESCRIPTION OF THE PREFERRED EMBODIMENT

Figures 1A, 1B:
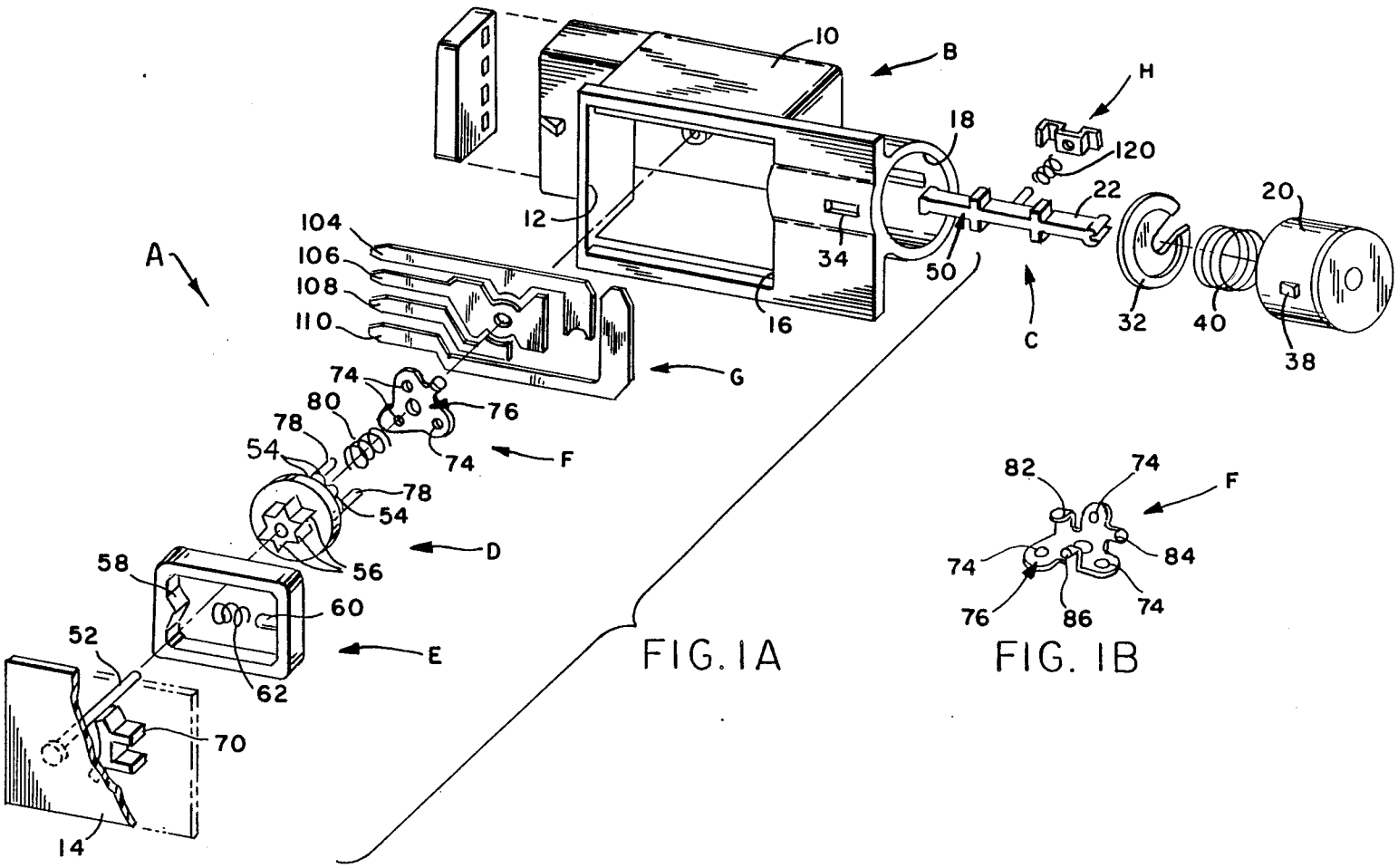
FIG. 1A is an exploded, perspective view of the switch according to the subject invention.
FIG. 1B is an enlarged, perspective of the substantially rigid first wiper of the subject invention.

Referring now to the drawings wherein the showings are for purposes of illustrating the preferred embodiment of the invention only and not for purposes of limiting same, the FIGURES show a dimmer switch A having a housing B in which is disposed an actuating plunger C adapted to cooperate with a cam D. A cam follower E selectively interengages the cam to facilitate positioning of a first wiper F with respect to an electrical contact G. A second wiper H also selectively engages various portions of the electrical contact to provide a flash-to-pass feature.

Figure 2:
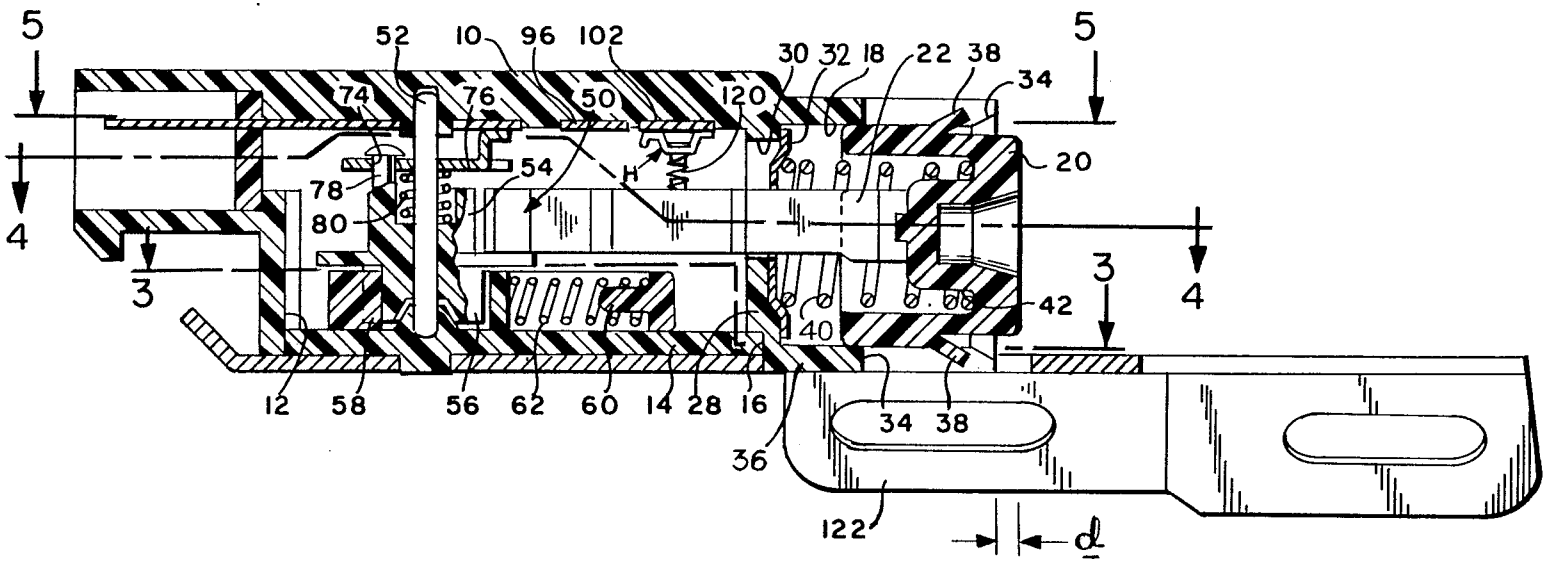
FIG. 2 is a longitudinal, cross-sectional view of a switch assembled in accordance with the subject invention.

More specifically, and with reference to FIGS. 1A and 2, the housing B includes body 10 having a central cavity 12 and a base 14 designed for covering relation with an opening 16 in the body. A first bore 18 is defined at a first end of the body and adapted to closely receive an actuator cap 20 and a first or outer end 22 of the actuating plunger C. The actuator cap 20 operatively receives the plunger first end 22 so that axial movement of the cap is transmitted to the plunger. End wall 28 of the housing includes an opening 30 adapted to receive the actuating plunger C therethrough. The end wall 28, in conjunction with stop plate 32, divides the central cavity 12 from the first bore 18. Further, the stop plate 32 defines a first or inner stop limit for travel of the actuator cap 20 toward the central cavity.

A pair of opposed slots 34 are formed in sidewall 36 defining the first bore 18 and adapted to receive projections 38 extending outwardly from the actuator cap. As illustrated in FIG. 2, the projections engage one end of the slots 34 to define a second or outer stop limit of the actuator cap movement in the bore. The cap is biased toward the outer stop limit by spring 40 disposed between the stop plate 32 and an inner annular recess 42 formed in the cap.

A second or inner end 50 of the plunger is disposed in the cavity and selective depression of the actuator cap toward the end wall 30, in turn, advances the plunger inner end 50 toward the cam or ratchet D. The cam is mounted on pin 52 for selective rotation relative to the pin and housing. The cam further includes a series of depressions or grooves thereby forming a plurality of ratchet teeth 54 designed for selective abutting engagement with the plunger inner end 50. As is apparent from FIG. 4, the reciprocating movement of the plunger is designed to be off-center from the axis of rotation of the cam, defined by pin 52. In this manner, and as viewed in FIG. 4, a clockwise rotation is imparted to the cam through selective depression and movement of the plunger toward the left.

Figure 3A:
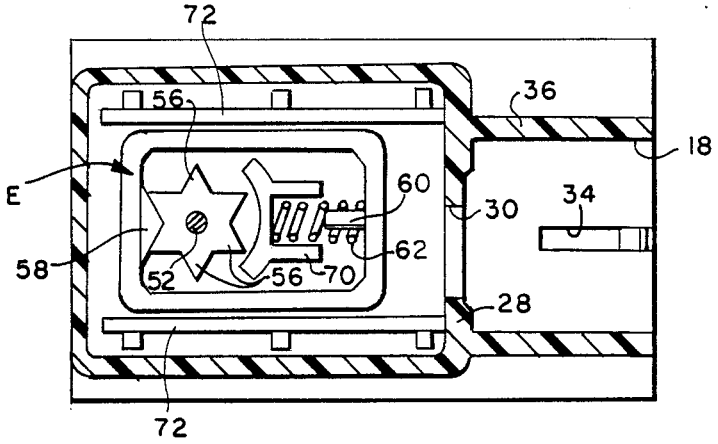
FIGS. 3A, 3B and 3C are a series of detailed, cross-sectional views along the lines 3—3 of FIG. 2 illustrating different operative positions of a cam and cam follower used in the switch.
Figure 3B:
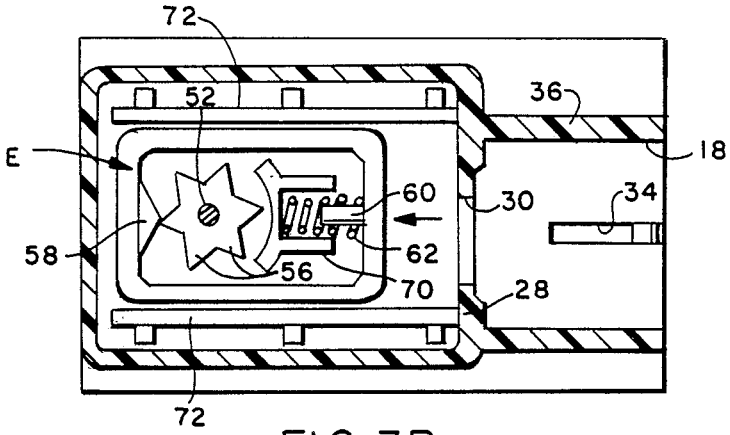
Figure 3C:
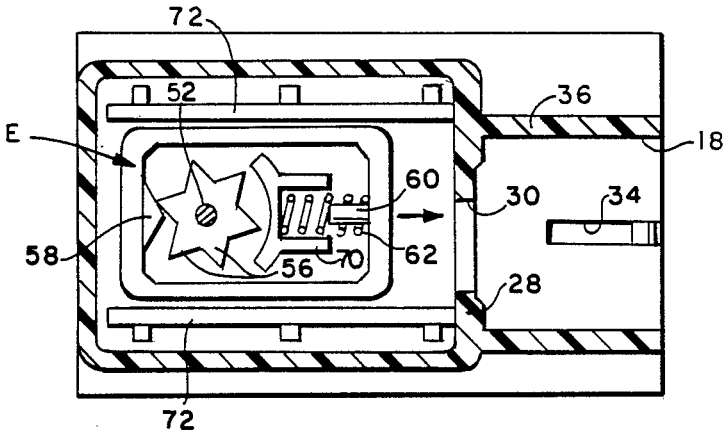

A lower portion of the cam adjacent the base 14 includes a series of teeth or peaks and valleys 56 (FIGS. 1A, 3A–C) designed for detenting action with cam follower E. More particularly, the cam follower includes an inwardly pointed projection 58 adapted for selective engagement with the cam teeth 56. The cam follower E is of generally annular shape and includes a spring mounting nub 60 extending inwardly from the cam follower at an area opposite the pointed projection 58. The mounting nub 60 operatively receives a spring 62 for biasing the cam follower. In the at-rest position of FIG. 3A, the pointed projection 58 is positioned between a pair of adjacent teeth 56 of the cam, i.e. a valley. The pointed projection and teeth define an interlocking means providing detented rotation of the cam around its pin axis. The cam follower E is free to move in generally parallel relation with the reciprocating action of the plunger C. The force exerted by spring 62 interposed between spring wall 70 and mounting nub 60 biases the cam follower to the right as shown in FIGS. 3A–C. Lateral movement of the cam follower is constrained by opposed channel-forming walls 72 extending into the cavity from base 14.

Figure 4:
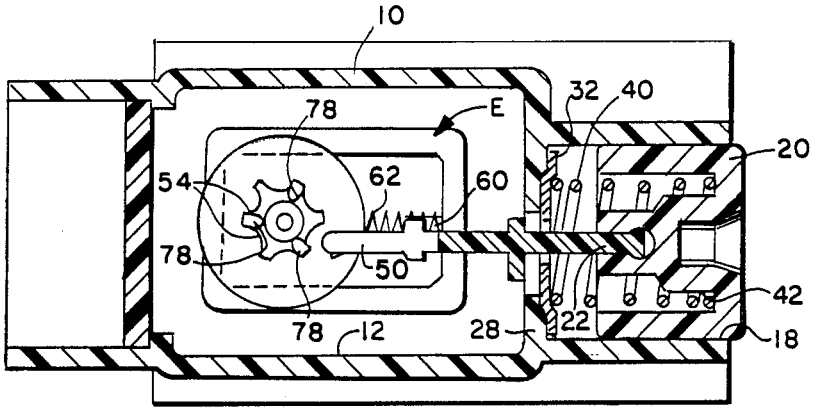
FIG. 4 is a detailed, cross-sectional view along the lines 4—4 of FIG. 2.

Depression of the actuator cap 20 moves the plunger toward the left and into engagement with a selected ratchet tooth 54. The plunger has been removed from FIGS. 3A–C for ease of illustration although it will be understood by those skilled in the art that it cooperates with the cam grooves as depicted in FIGS. 2 and 4. Rotation of the cam from its at-rest position of FIG. 3A is initially restrained due to the interlocking detent action of the projection 58 and teeth 56 of the cam in addition to the opposed biasing force exerted by spring 62. An increase in the actuating force is necessary so that the teeth 56 and pointed projection 58 can be repositioned for cam rotational movement. This increase in actuating force is proportional to the opposed biasing force exerted by spring 62 on the cam follower since the cam is constrained from axial movement as a result of its pin mounting. The increased force and leftward movement of the plunger actuates rotary movement of the cam. A tooth of the cam, in turn, slides along the pointed projection 58 and pushes the cam follower to the left, positioning the apex of a tooth 56 with the apex of the pointed projection 58 during the maximum point of cam follower movement to the left (FIG. 3B). This apex-to-apex position thus creates an instability whereupon an over-center toggle or snap-action occurs producing addition rapid rotary movement of the cam independent of movement of the plunger. The channel-forming walls 72 insure that only longitudinal movement of the cam follower is permitted. Once the apexes pass over one another, the energy stored in spring 62 assists the cam follower back to the right as illustrated in FIG. 3C. Continued clockwise rotation of the cam follower proceeds at an extremely rapid pace without further assistance from the plunger. The plunger is thereafter biased toward the right as a result of forces stored in the compressed spring 40. Cam rotation continues until a valley defined between adjacent cam teeth aligns with the pointed projection. The cam assumes, once again, the at-rest position with respect to the cam follower as illustrated in FIG. 3A.

The substantially rigid first wiper F is fixedly secured to the cam D at an upper portion thereof disposed away from the base 14. Apertures 74 are formed in a base portion 76 of the first wiper. Legs 78 extend integrally outward from the cam upper portion and through the apertures 74. The outermost ends of the legs are, thereafter, deformed during assembly to retain the first wiper thereon. Means for biasing, such as spring 80, biases the first wiper into engagement with the deformed ends of the legs 78.

The first wiper F is of substantially rigid construction and includes first, second and third wiper arm 82, 84, 86 (FIG. 1B) extending from the base portion 76. Due to the rigid construction of the first wiper, and in conjunction with the spring 80, a common, constant contact force is imposed on electrical contact G. Each of the wiper arms exerts the same force on the electrical contact and manufacture of the rigid first wiper is simplified with respect to prior art constructions.

Figure 5:
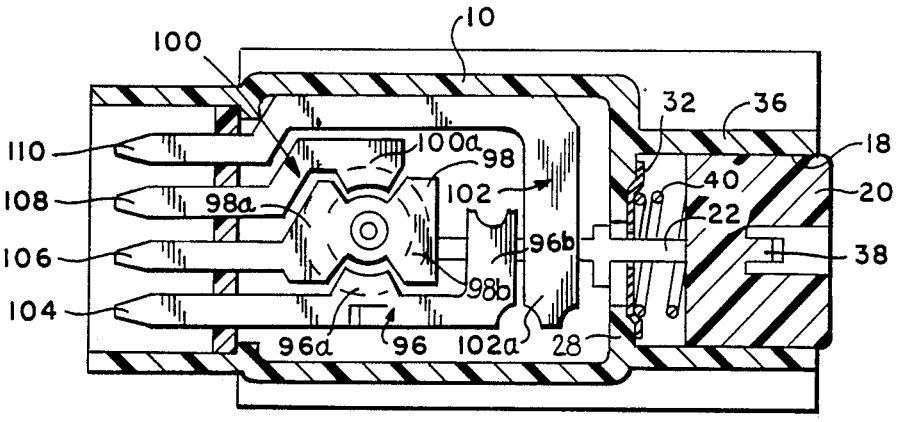
FIG. 5 is a detailed, cross-sectional view along the lines 5—5 of FIG. 2.
Figure 6:
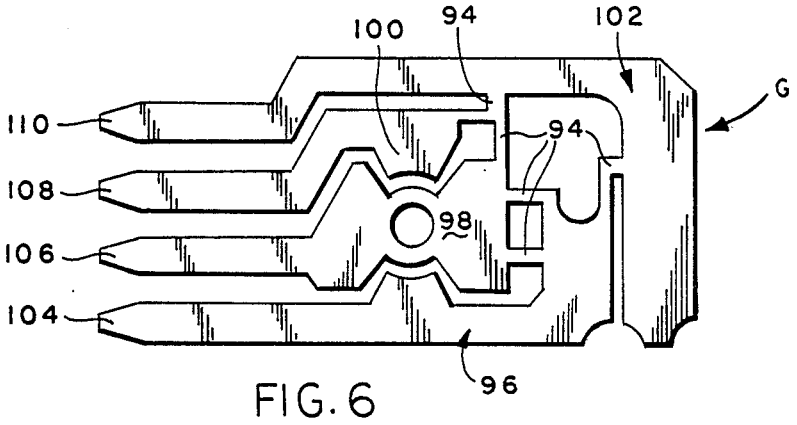
FIG. 6 is a plan view of the unitary electrical contact and terminals formed in accordance with the subject invention; and, FIG. 7 is a schematic representation generally illustrating the changes in force with the travel of the actuating plunger.

With particular reference to FIGS. 5 and 6, the electrical contact G will be described in greater detail. The contact may be formed through a stamping operation or the like from a single piece in which terminals for hard wiring are an integral portion thereof (FIG. 6). Once the contact is inserted and positioned in the housing cavity 12, selected joining areas 94 are broken so that the electrical contact G forms four distinct contact portions 96, 98, 100, 102. Each contact portion 96, 98, 100, 102 has an associated terminal 104, 106, 108, 110, respectively.

Although the terminals may be connected in a different fashion for different applications, according to the preferred embodiment, the first contact portion 96 is connected to the high beams of an associated head light assembly of an automotive vehicle through first terminal 104. The contact portion 96 includes a first enlarged region 96*a* of generally segmented annular configuration. The first region 96*a* is disposed in close-spaced relation with pin 52 for selective electrical contact with the wiper arms. A second enlarged region 96*b* extends toward the end wall 28 and actuator cap for selective electrical contact as will be described below.

The second contact portion 98 is connected to the "hot" side of a battery (not shown) through second terminal 106. The second contact portion includes two diametrically opposed, enlarged regions 98*a* and 98*b* having the general shape of a segment of an annulus. These opposed regions have a greater angular embrace than the annular regions defined by the first and third contact portions. As is known in the art, this design arrangement coupled with predetermined wiper arm dimensioning provides for a make-before-break arrangement. The enlarged regions 98*a* and 98*b* receive enlarged region 96*a* therebetween and are also adapted for selective engagement with the wiper arms.

The third contact portion 100 is connected to the low beams of an associated headlight assembly through the third terminal 108. In similar fashion, an enlarged, annular region 100*a* is positioned opposite enlarged region 96*a* and between regions 98*a* and 98*b* or the second contact portion. The three wiper arms 82, 84, 86 selectively electrically connect the high and low contact portions with the hot terminal. The changeover from the high beam to low beam interconnection with the hot terminal, or vice versa, is made in a make-before-break fashion. Thus, in a selected portion of the rotation of the first wiper F, both the first contact portion 96 and second contact portion 100 are interconnected with the second contact portion 98. This switching is done at high speed independent of the speed of actuation by the over-center toggle action of the apex-to-apex engagement of follower 58 with cam 56. The improved design offered by the detent action of the cam and cam follower, therefore, results in improved switching and reduced arcing.

The fourth contact portion is best described as a flash contact portion which is always connected to a hot line through the fourth terminal 110. The fourth contact portion includes an enlarged region 102*a* interposed between the end wall 28 and the second enlarged portion 96*b* of the first contact portion. Due to the connection with the hot side of the battery, selective interconnection between the flash contact portion 102 and the first contact portion 96 actuates the high beams of the automotive headlights irrespective of whether the headlights are actuated or not.

According to the preferred embodiment, the means for actuating the flash-to-pass feature includes the second wiper H mounted on the actuating plunger C at an area intermediate the first end 22 and the second end 50 thereof. The second wiper is biased into operative engagement with the fourth contact enlarged portion 102*a* by spring 120. This at-rest position is clearly illustrated in FIGS. 2 and 4. Movement of the plunger to the left in FIG. 2 moves the second wiper H into operative engagement with the first contact enlarged portion 96*b*. The second wiper interconnects the flash and high contact portions 102, 96, respectively, so as to actuate the high beams in a flash-to-pass condition.

Moreover, the second wiper H is intermediately positioned on the actuating plunger 20 such that the flash-to-pass condition is actuated before the plunger second end 50 engages a ratchet tooth 54. Thus, only partial movement of the cap and plunger to the left, as shown in FIG. 2, is required to interconnect the first and fourth contact portions. A vehicle operator can release the actuator cap at this point without engaging the cam and switching from a high to low beam position, or vice versa.

Figure 7:
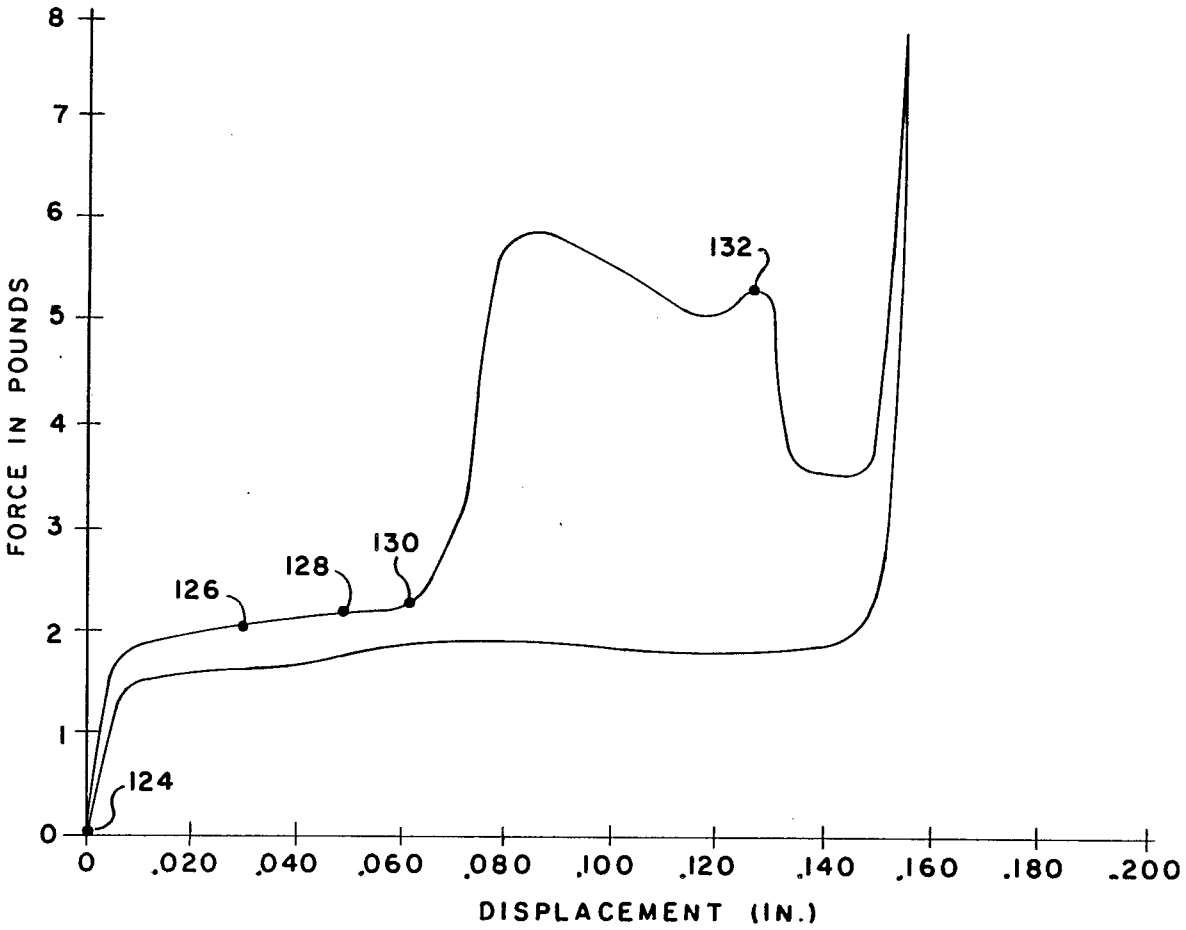

Turning now to FIG. 7, a displacement versus force curve illustrates the change in force as the actuating plunger C is fully depressed and released. Further, the associated sequence of events during switch actuation are clearly illustrated. Initially, the actuator cap extends outwardly from the body a distance d to assist in mounting the assembly to the steering column (FIG. 2). The assembled switch is attached to a bracket 122 to facilitate mounting. The actuator cap is depressed until a flush feel or sight is achieved with respect to the actuator body 10, thus indicating proper positioning on the steering column.

Referring now to the graphical representation of FIG. 7, the initial, at-rest position of the actuator cap is illustrated at point 124. The flush position of the actuator cap relative to the body is represented by point 126 on the graph. As described above, this flush positioning facilitates mounting to the steering column. Continued depression of the actuator cap forces the second wiper H to complete electrical connection between contact portions 96 and 102, specifically 96*b* and 102*a*. This flash-to-pass solution is represented at 128. As is apparent, only a slight, generally linear increase is detected in the actuating force necessary to displace the plunger.

The base 130 of the steep rise and increased force with a small amount of displacement is representative of the plunger second end 50 engaging a ratchet tooth 54. As detailed above and illustrated in FIGS. 3A to 3C, the force of spring 40 is encountered as relative movement between the cam and cam follower begins. The apexes of the teeth 56 and the projection 58 become aligned as represented by trip position 132 and the force decreases rapidly thereafter for the small amount of plunger movement. This is representative of the condition illustrated in FIG. 3C in which the force of spring 40 now assists in rotation of the cam as the cam follower reaches an overcenter position. Nevertheless, and as indicated above, the switching arrangement provides a make-before-break action and is done at high speed independent of the speed of actuation of the plunger. This results in improved switching and reduced arcing.

The subject invention eliminates uneven contact force between the first wiper and contact portions through use of a rigid, spring biased wiper assembly. Further, assembly of the switch is facilitated through use of an integral, generally planar electrical contact G. Still further, the switch is advantageously provided with a second wiper that adds a flash-to-pass feature to the dimmer switch.

The invention has been described with reference to the preferred embodiment. Obviously modifications and alterations will occur to others upon a reading and understanding of this specification. It is intended to include all such modifications and alterations insofar as they come within the scope of the appended claims or the equivalents thereof.

Having thus described the invention, it is now claimed:

1. A switch comprising:

a housing;

actuating means mounted for selective advance and retract reciprocating movement relative to said housing for effecting switch actuation;

means biasing said actuating means in said retract direction;

cam means rotatably mounted in said housing and including ratchet means, said cam means selectively engaged with a first end of said actuating means and rotated in one direction upon said reciprocating movement;

a substantially rigid first wiper operatively associated with said cam means;

cam follower means movably guided for sliding movement mounted in said housing and operative to provide over-center snap action for rotation of said cam, said cam follower means including a member having a pair of spaced parallel guide surfaces guided for said sliding movement by said housing with said cam means disposed between said guide surfaces and including detent means operative to engage said ratchet means and urge said cam means to an at-rest position;

bias means disposed on the opposite side of said ratchet means from said detent means and operative to urge said cam follower means in a direction of said sliding movement to maintain contact with said cam means;

means defining a plurality of stationary contact portions adapted for selective electrical interconnection by said substantially rigid first wiper, said first wiper upon rotation being operative to complete electrical connection with selected one of said contact portions before it breaks electrical connection with selected other contact portions; and, said actuating means, upon said advance movement, being operative to move said cam means to cause said completion of electrical connection of said selected ones of said contact portions, before said over-center snap action occurs, and operative upon continued movement to cause said over-center snap action to break the electrical connection of said other contact portions, said movement of said cam means after said over-center snap action being independent of movement of said actuating means.

2. The switch defined in claim 1, wherein the force required to effect said advance movement of said actuating means reaches a relative maximum prior to said over-center snap action.

3. A switch comprising:

a housing;

a plunger having opposed first and second ends and mounted for reciprocating advance and retraction movement in said housing;

a ratchet member rotatably mounted in said housing and selectively engaged by said plunger second end upon advance movement thereof, said ratchet member defining a cam surface thereon;

a cam follower resiliently biased against said cam surface and including detent means engaging said ratchet member, said cam follower including a pair of spaced parallel guide surfaces guided for sliding movement in said housing with said ratchet disposed between said guide surfaces;

bias means disposed on the opposite side of said ratchet member from said detent means a substantially rigid first wiper rotatable with said ratchet member;

means mounted on said housing defining a plurality of discrete contact portions contacted by said first wiper wherein selected ones of said contact portions are connected before selected other contact portions are disconnected and, said follower is operative upon advancement to effect an over-center snap to said ratchet member upon advance movement of said plunger, said ratchet member operative to effect said connection of said selected ones of said contact portions before said snap action and said disconnecting of said other contact portions after said snap action, said movement of said ratchet member after said over-center snap action being independent of said plunger movement.

4. The switch defined in claim 3 further comprising a second wiper interposed between said plunger ends for selective electrical connection with various ones of said contact portions, said second wiper completing electrical connection between said contact portions prior to engagement between said cam and plunger second end.

5. The switch defined in claim 4, wherein the force required to affect said advance movement of said plunger reaches a relative maximum prior to said over-center snap action;

6. The switch defined in claim 5, wherein said first wiper has three arms and said means mounted on said housing defines three contact portions with one of said portions defining a greater angular embrace about the center of rotation of said ratchet member, and two of said wiper arms are in contact with said contact portion having the grater angular embrace at said at-rest position.

* * * * *